US011177616B2

(12) United States Patent
Edenhofer et al.

(10) Patent No.: US 11,177,616 B2
(45) Date of Patent: Nov. 16, 2021

(54) ELECTRICAL PLUG WITH A PROTECTIVE CONDUCTOR CONTACT AND PROTECTIVE CONDUCTOR CONNECTOR ELEMENT FORMED INTEGRALLY THEREWITH FOR GROUNDING EXTERIOR PARTS

(71) Applicant: TE Connectivity Industrial GmbH, Niederwinkling (DE)

(72) Inventors: Herbert Edenhofer, Schwarzach (DE); Josef Achatz, Lalling (DE); Philipp Moncher, Perasdorf (DE)

(73) Assignee: TE Connectivity Industrial GmbH, Niederwinkling (DE)

( * ) Notice: Subject to any disclaimer, the term of this patent is extended or adjusted under 35 U.S.C. 154(b) by 0 days.

(21) Appl. No.: 16/719,162

(22) Filed: Dec. 18, 2019

(65) Prior Publication Data

US 2020/0127423 A1 Apr. 23, 2020

Related U.S. Application Data

(63) Continuation of application No. PCT/EP2018/064926, filed on Jun. 6, 2018.

(30) Foreign Application Priority Data

Jun. 22, 2017 (DE) ..... 102017113875.7

(51) Int. Cl.
*H01R 13/648* (2006.01)
*H01R 13/6597* (2011.01)
(Continued)

(52) U.S. Cl.
CPC ..... *H01R 13/6597* (2013.01); *H01R 13/42* (2013.01); *H01R 13/6581* (2013.01)

(58) Field of Classification Search
CPC . H01R 13/42; H01R 13/6581; H01R 13/6597
(Continued)

(56) References Cited

U.S. PATENT DOCUMENTS 3,031,635 A * 4/1962 Gluck ..... H01R 33/7628 439/607.34
4,113,341 A * 9/1978 Hughes ..... H01R 13/66 439/620.21
(Continued)

FOREIGN PATENT DOCUMENTS

CN 1223487 A 7/1999
CN 101228673 A 7/2008
(Continued)

OTHER PUBLICATIONS

Abstract of DE202015102170, dated Jun. 25, 2015, 1 page.
(Continued)

*Primary Examiner* — Abdullah A Riyami
*Assistant Examiner* — Vladimir Imas
(74) *Attorney, Agent, or Firm* — Barley Snyder

(57) ABSTRACT

An electrical plug includes a plug housing having a first housing exterior part and a second housing exterior part separate from the first housing exterior part, a protective conductor contact disposed in the plug housing, and a protective conductor connector element disposed in the plug housing. The first housing exterior part and the second housing exterior part are each at least partially made of metal. The protective conductor connector element is connected to the protective conductor contact and is electrically connected to at least one of the first housing exterior part and the second housing exterior part.

20 Claims, 7 Drawing Sheets

(51) Int. Cl.
*H01R 13/42* (2006.01)
*H01R 13/6581* (2011.01)

(58) Field of Classification Search
USPC ..... 439/607.34
See application file for complete search history.

(56) References Cited

U.S. PATENT DOCUMENTS

| | | | | |
|---|---|---|---|---|
| 4,925,405 | A * | 5/1990 | Wei | H01R 13/6582 439/607.4 |
| 5,573,411 | A | 11/1996 | Bartosz | |
| 5,647,766 | A * | 7/1997 | Nguyen | H01R 13/7197 439/103 |
| 6,319,063 | B1 * | 11/2001 | Huang | H01R 13/6582 439/607.36 |
| 7,537,466 | B2 | 5/2009 | Bartholoma et al. | |
| 7,753,730 | B2 * | 7/2010 | Furio | H01R 9/032 439/607.08 |
| 7,946,882 | B2 * | 5/2011 | Wu | H01R 13/648 439/108 |
| 8,398,434 | B2 * | 3/2013 | Davis | H01R 13/6587 439/607.34 |
| 8,801,466 | B2 * | 8/2014 | Wimmer | H01R 13/6591 439/607.34 |
| 8,858,258 | B2 * | 10/2014 | Stokowski | H01R 13/42 439/582 |
| 9,332,668 | B2 * | 5/2016 | Nishio | H05K 5/0039 |
| 9,608,343 | B2 * | 3/2017 | Paynter | H01R 9/0503 |
| 10,027,073 | B2 * | 7/2018 | Tokita | H01R 24/38 |
| 10,148,030 | B2 * | 12/2018 | Krech | H01R 4/489 |
| 10,153,595 | B2 * | 12/2018 | Quero | H01R 13/521 |
| 10,424,880 | B2 * | 9/2019 | Yoshiura | H01R 13/4223 |
| 10,439,335 | B2 * | 10/2019 | Hieber | H01R 13/6597 |

FOREIGN PATENT DOCUMENTS

| | | | |
|---|---|---|---|
| CN | 203135128 | U | 8/2013 |
| CN | 204230513 | U | 3/2015 |
| DE | 20018034 | U1 | 2/2001 |
| DE | 202005000229 | U1 | 3/2005 |
| DE | 202015102170 | U1 | 11/2013 |
| DE | 202015102170 | U1 | 6/2015 |
| EP | 0475414 | A1 | 9/1991 |
| EP | 0924808 | A1 | 6/1999 |
| EP | 3089284 | A1 | 11/2016 |

OTHER PUBLICATIONS

PCT Written Opinion of the International Searching Authority and International Search Report, dated Aug. 13, 2018, 9 pages.
Abstract of DE202005000229, dated Mar. 31, 2005, 1 page.
Chinese First Office Action and English translation, dated Aug. 3, 2020, 17 pages.
Abstract of EP 3089284 A1, dated Nov. 2, 2016, 1 page.
Abstract of CN 203135128 U, dated Aug. 14, 2013, 1 page.
Abstract of CN 204230513 U, dated Mar. 25, 2015, 1 page.
European Patent Office Communication, dated Mar. 16, 2021, 7 pages.

* cited by examiner

ELECTRICAL PLUG WITH A PROTECTIVE CONDUCTOR CONTACT AND PROTECTIVE CONDUCTOR CONNECTOR ELEMENT FORMED INTEGRALLY THEREWITH FOR GROUNDING EXTERIOR PARTS

CROSS-REFERENCE TO RELATED APPLICATIONS

This application is a continuation of PCT International Application No. PCT/EP2018/064926, filed on Jun. 6, 2018, which claims priority under 35 U.S.C. § 119 to German Patent Application No. 102017113875.7, filed on Jun. 22, 2017.

FIELD OF THE INVENTION

The present invention relates to an electrical plug with a plug housing and, more particularly, to an electrical plug with a plug housing having multiple housing exterior parts.

BACKGROUND

Electrical plugs can have a plug housing with a first housing exterior part and a separate second housing exterior part. The first housing exterior part and the second housing exterior part are each metallic at least in certain areas. Such electrical plugs, which are respectively formed for connection to further components on their at least two end sides, are also referred to as plug connectors, and can be connected to a separate aggregate such as a motor housing. Electrical plugs formed as angle plugs are disclosed in German Patent Application Nos. DE 202015102170 U1 and DE202005000229 U1.

Electrical plugs usually comprise multiple electrical contacts, formed as contact pins, by which signals, in particular data signals and signals for energy transfer, can be transferred. Moreover, such electrical plugs also comprise a ground contact or a protective conductor contact. Because housing exterior parts are metallically formed in electrical plugs, they must be grounded.

Individual strands are crimped to a ground contact or a protective conductor contact in known implementations. Especially in configurations of electrical plugs, which comprise multiple separate housing exterior parts and optionally moreover also additional exterior parts, a more extensive configuration of the protective conductor connections is required. Such configurations become very expensive due to the high assembly effort required and associated higher costs.

In configurations of electrical plugs with multiple housing exterior parts, grounding is effected or is arranged in one of the housing exterior parts and the remaining parts are then grounded by respectively metallic connections. Corresponding electrical connections for this ground are formed by screw connections. However, such screws are also critical components since they have relatively poor electrical conductivity and can also corrode over time. Especially in configurations of electrical plugs with multiple separate housing exterior parts, which are formed of zinc die cast, the pressing force of the housing exterior parts connected to each other falls due to the flow behavior of the zinc. Thereby too, the electrical transition resistance increases over time such that the requirements to the ground connections may no longer be achieved and the electrical plug must be exchanged. Thereby, the longevity of the electrical plug can also be impaired.

SUMMARY

An electrical plug includes a plug housing having a first housing exterior part and a second housing exterior part separate from the first housing exterior part, a protective conductor contact disposed in the plug housing, and a protective conductor connector element disposed in the plug housing. The first housing exterior part and the second housing exterior part are each at least partially made of metal. The protective conductor connector element is connected to the protective conductor contact and is electrically connected to at least one of the first housing exterior part and the second housing exterior part.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
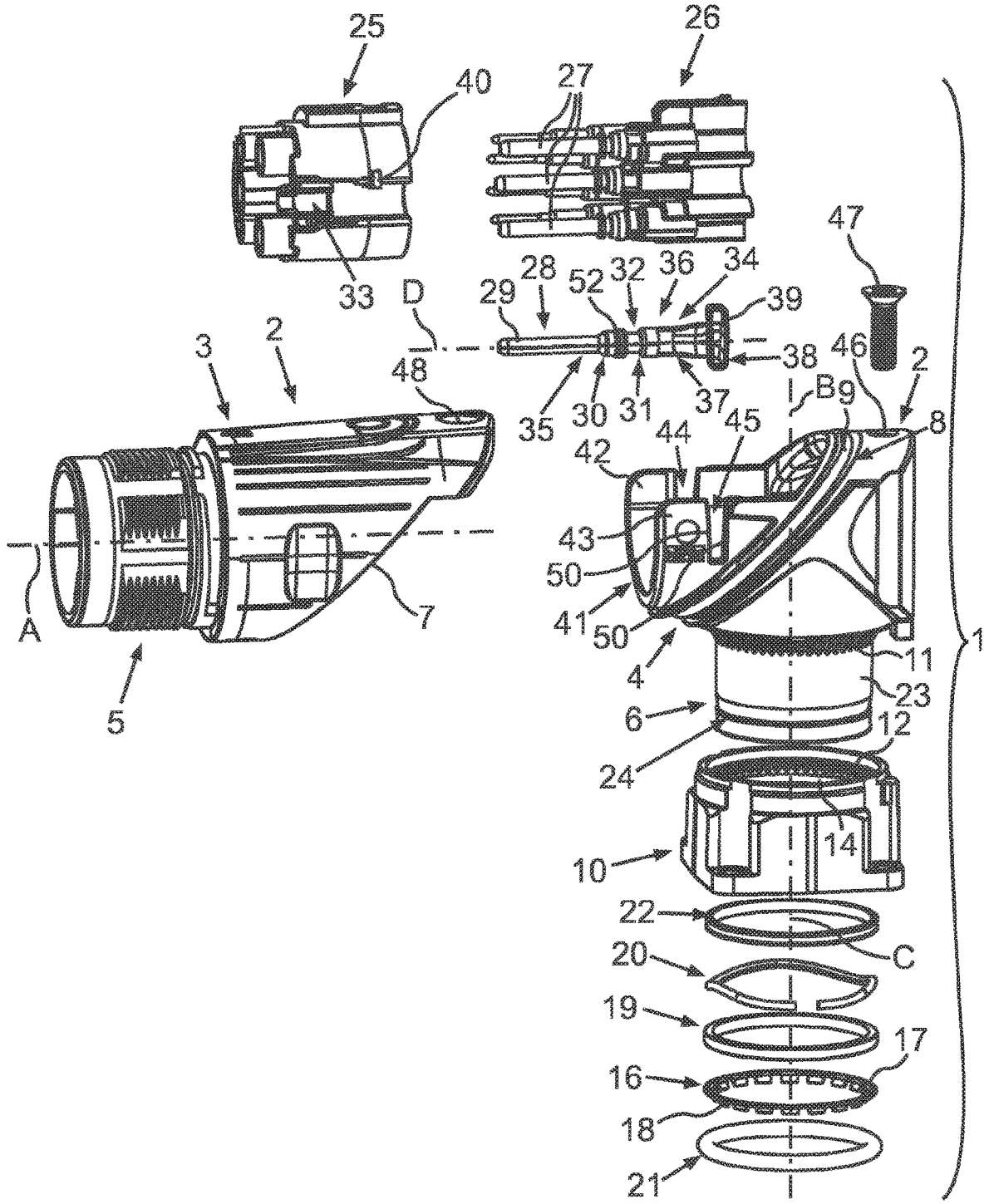
FIG. 1 is an exploded perspective view of an electrical plug according to an embodiment.

Exemplary embodiments of the present invention will be described hereinafter in detail with reference to the attached drawings, wherein like reference numerals refer to like elements. The present invention may, however, be embodied in many different forms and should not be construed as being limited to the embodiments set forth herein. Rather, these embodiments are provided so that the present disclosure will be thorough and complete and will fully convey the concept of the disclosure to those skilled in the art.

The features and feature combinations described herein are usable not only in the respectively specified combination, but also in other combinations or alone without departing from the scope of the invention. Thus, implementations are also to be considered as encompassed and disclosed by the invention, which are not explicitly shown in the figures and explained, but arise from and can be generated by separated feature combinations from the explained implementations. Implementations and feature combinations are also to be considered as disclosed, which thus do not comprise all of the features of an originally formulated independent claim.

Throughout the description, the indications of "top", "bottom", "front", "rear", "horizontal", "vertical", "depth direction", "width direction", "height direction", and the positions and orientations given in the described use and arrangement of the apparatus are with an observer standing in front of the apparatus and looking towards the apparatus.

An electrical plug 1 or a plug connector according to an embodiment is shown in FIG. 1. In the shown embodiment, the electrical plug 1 is an angle plug connector.

The electrical plug 1, as shown in FIG. 1, comprises a plug housing 2. In the shown embodiment, the plug housing 2 has a housing front part that is formed by a first housing exterior part 3. The first housing exterior part 3 is made of metal, in particular zinc die cast. The plug housing 2 comprises a second housing exterior part 4 separate from the first housing exterior part 3. The second housing exterior part 4 is also made of metal, in particular zinc die cast. The first housing exterior part 3 has a longitudinal axis A. A first connection area 5 for connecting to a further component, for example to an aggregate or an electrical line, is formed at an end of the first housing exterior part 3 facing away from the second housing exterior part 4. The second housing exterior part 4 has a longitudinal axis B, and a second connection area 6 is formed at an end of the second housing exterior part 4 facing away from the first housing exterior part 3.

The two longitudinal axes A and B are oriented at an angle between 60° and 120°, between 80° and 100°, or of 90° to each other in various embodiments. In an assembled state, the two housing exterior parts 3 and 4 are connected to each other and abut on each other with abutment edges 7, 8. In an embodiment, a seal 9 is intermediately arranged between the abutment edges 7, 8. The abutment edges 7, 8 are each formed in oblique sectional planes to the longitudinal axes A and B and thus extend in planes that are not oriented perpendicular to the longitudinal axes A and B.

The plug housing 2, as shown in FIG. 1, includes a connection flange 10 formed of metal and representing an exterior part of the electrical plug 1. The connection flange 10 is separate to the two housing exterior parts 3, 4 and connected to the second housing exterior part 4 in the assembled state. The connection flange 10 has a longitudinal axis C, which is in oriented coaxially to the longitudinal axis B. With the connection flange 10, the electrical plug 1 can be arranged on a separate aggregate, for example a motor housing.

The second housing exterior part 4, as shown in FIG. 1, has a housing spur gearing 11 oriented axially and thus oriented in the direction of the longitudinal axis B. The connection flange 10 has a flange spur gearing 12, which is axially oriented and formed interiorly in the connection flange 10. In the assembled state, the spur gearings 11 and 12 engage with each other such that a position of the connection flange 10 to the second housing exterior part 4 is secured in circumferential direction around the axis B and thus azimuthal around the axis B. Thus, a rotation protection is also formed by the spur gearings 11 and 12, which engage with each other.

The electrical plug 1 comprises a retaining device or an axial retaining device, by which the connection flange 10 is axially retained in defined position to the second housing exterior part 4 and thereby is also connected to the second housing exterior part 4. The connection flange 10 is fixed to the second housing exterior part 4 by the axial retaining device. The axial retaining device is a radial stop 13, shown in FIG. 6, which is integrally formed on an inner side 14 of the connection flange 10 and is oriented radially inwards protruding. In the assembled state of the plug 1, the radial stop 13 is oriented in the direction of an outer side 23 of the second housing exterior part 4, shown in FIG. 1.

Figure 6:
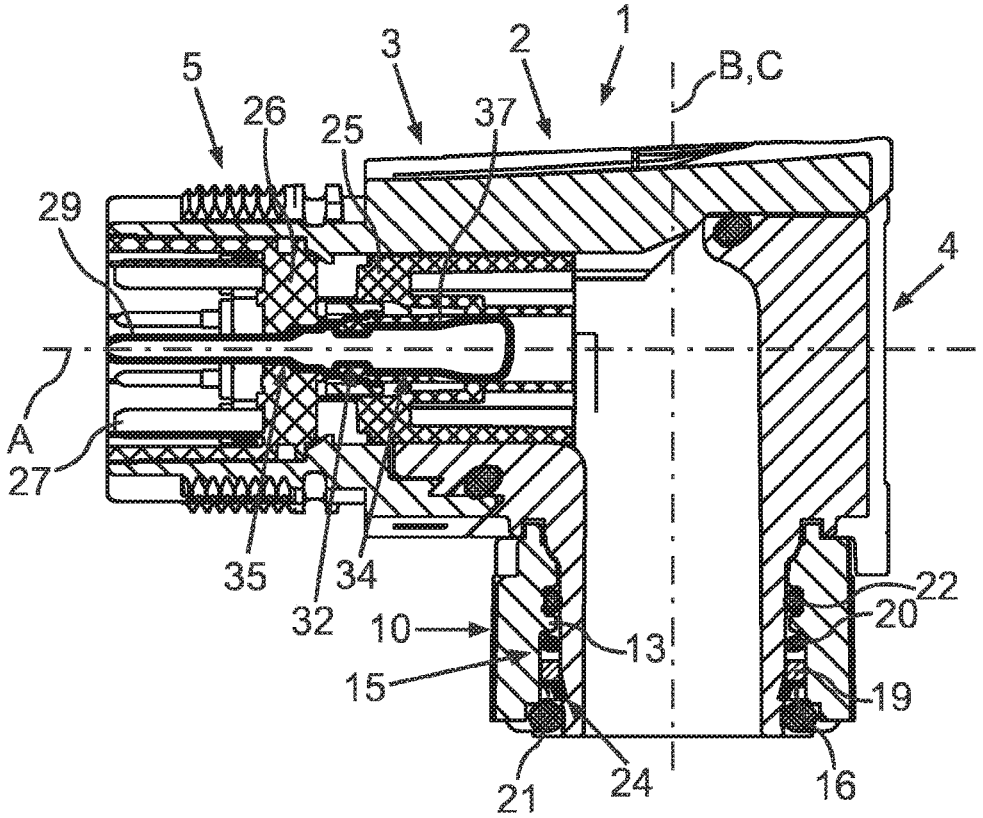
FIG. 6 is a sectional side view of the electrical plug, taken along line VI-VI of FIG. 5.

The axial retaining device includes a counter bearing 15, shown in FIG. 6, which is in operative connection with the second housing exterior part 4 for setting the axial position between the second housing exterior part 4 and the connection flange 10. The counter bearing 15 has a locking ring 16, which is circumferentially closed. The locking ring 16 includes a base ring 17, at which a plurality of separate locking flaps 18, only some of which are provided with the corresponding reference character in FIG. 1 for the sake of clarity, are formed here oriented to the bottom. The locking flaps 18 are constituents of a locking device, which is formed at the locking ring 16. The locking ring 16 is integrally formed such that the locking flaps 18 are formed joining to the base ring 17 and integrated thereon.

The counter bearing 15, as shown in FIGS. 1 and 6, includes a support ring 19, which is formed as a separate component to the locking ring 16. The support ring 19 is also formed circumferentially closed. The support ring 19 is formed cornered and, in various embodiments, may be quadrangular or rectangular in cross-section. The locking ring 16 and the support ring 19 may each be referred to as a contact ring in an embodiment.

The axial retaining device, as shown in FIGS. 1 and 6, includes a spring element 20, which is a wave spring in an embodiment. The spring element 20 is not a closed ring, but a ring section, which extends over an angular length between 320° and 350° in an azimuthal direction. The undulation of the spring element 20 viewed in this azimuthal direction is apparent.

The electrical plug 1, as shown in FIG. 1, comprises multiple seals 21 and 22. The seals 21, 22 are sealing rings and, in an embodiment, are O-rings.

As shown in FIGS. 1 and 6, as threads and a radial material constriction are not formed on the inner side 14 and the outer side 23, the mechanical strength of the connection flange 10 and the second housing exterior part 4 is increased in this connection area. Therefore, a relatively large thickness or non-constricted wall thickness remains at a locking shoulder of a locking element and thus of the locking ring 16. Only by a locking groove 24, a slight wall thickness reduction occurs on the outer side 23 and also only at the second housing exterior part 4. The internal diameter of the socket and thus also of the connection flange 10 remains unchanged and thus consistent in this context, which favors the mechanical loading capacity and thus the increase of the strength.

An electrical connection between the metallic connection flange 10 and the second housing exterior part 4 is formed by the support ring 19 and/or the locking ring 16 such that grounding is allowed via this electrical connection.

The electrical plug 1, as shown in FIG. 1, includes a cylindrical insulating body 25, which is also a separate component and, in an embodiment, is formed of plastic. In the insulating body 25, which includes a contact support 26 for receiving a plurality of electrical contacts 27, the plurality of pin-like contacts 27 are arranged. These electrical contacts 27 transfer signals, in particular data signals and/or energy signals. In an embodiment, the insulating body 25 is integrally formed.

The electrical plug 1, as shown in FIG. 1, includes at least one pin-like protective conductor contact 28. The protective conductor contact 28 is arranged outside of a volume area of the tubular insulating body 25, in which the electrical contacts 27 are arranged. The protective conductor contact 28 has a pin-like front part 29 and a pair of bead areas 30 and 31, which are radially thicker than the front part 29. A locking groove 32 is formed between the bead areas 30, 31. The protective conductor contact 28 is receivable in locking manner in a radially open receptacle 33 of the insulating body 25 by the locking groove 32. The protective conductor contact 28 connects to a corresponding line strand of an electrical cable to provide a ground connection or a protective conductor connection. The electrical contacts 27 as well as the protective conductor contact 28 are arranged in the plug housing 2 in the assembled state.

The electrical plug 1, as shown in FIG. 1, includes a protective conductor connector element 34. The protective conductor connector element 34 is formed of metal and has a prefabricated shape body, which is arranged in the plug housing 2 without shape change also in the assembled state. The protective conductor connector element 34 establishes a direct electrical ground connection between the protective conductor contact 28 and the first housing exterior part 3 as well as the second housing exterior part 4. The housing exterior parts 3 and 4 represent components of the electrical plug 1 that are exposed towards the outside and thus can also be touched in the assembled state of the electrical plug 1.

The protective conductor connector element 34, as shown in FIG. 1, is formed as one piece with the protective conductor contact 28, forming an electrical overall contact element 35. The protective conductor connector element 34 is formed to a rear end 36 of the protective conductor contact 28 in the direction of a longitudinal axis D of the protective conductor contact 28. The protective conductor connector element 34 extends the protective conductor contact 28 to the rear and thus in the direction of the interior of the plug 1.

The protective conductor connector element 34 has a support part 37, as shown in FIG. 1. The support part 37 joins to the rear end 36 and extends axially along the longitudinal axis D. The support part 37 is formed as a half trough. The protective conductor connector element 34 has a contact part 38. The contact part 38 is arranged laterally protruding to the longitudinal axis D; it protrudes further outwards in this radial direction than the protective conductor contact 28. In an embodiment, the contact part 38 is a hollow body, in particular formed annular or duct-like. In another embodiment, the ring can be asymmetrically shaped and for example be formed oval or flattened; the hollow body can also be rectangularly configured. The hollow body can be formed circumferentially closed, or in another embodiment, can also be formed open, for example U-shaped.

The hollow body is circumferentially closed. A free circumferential edge 39 facing away from the support part 37, which bounds the shape of the hollow body, does not extend in a plane, but is curved. The edge 39 is a one-sided or front-side edge. A certain deformation elasticity is also given by the hollow body, such that the contact part 38 can then still be installed in corresponding positions, in particular be installed therein in accurately fitting manner, with manufacturing tolerances of the individual components of the electrical plug 1.

The overall contact element 35, in an embodiment, can be formed as a bending part, in particular as a metal sheet bending part. A provided blank or a corresponding blank cut is correspondingly formed by multiple bending processes such that the integral shape body according to FIG. 1 is readily manufactured before it is installed in the plug housing 2 as the overall contact element 35. In an embodiment, additional punching operations or the like can also be provided to be able to produce specifications of the overall contact element 35.

The overall contact element 35, as shown in FIG. 1, includes a contacting element 52. The contacting element 52 is formed integrally with the overall contact element 35 and is integrated in the protective conductor contact 28. The contacting element 52 is formed as a radial web or ring web. In an embodiment, the contacting element 52 is integrated in the bead 30 and extends radially further outwards than the remaining area of the bead 30. Moreover, the contacting element 52 directly bounds the locking groove 32. The contacting element 52, in an embodiment, generates an electrical connection between the protective conductor contact 28 and the first housing exterior part 3.

The insulating body 25, as shown in FIG. 1, has a radially protruding coupling stud 40 on an outer side. In the assembled final state of the plug 1, the coupling stud 40 protrudes into the hollow body of the contact part 38 such that an axial positional retention of the contact part 38 is supported.

As shown in FIG. 1, the second housing exterior part 4 has a trough-like section or a fluting area 41, to which the first housing exterior part 3 is fitted from above. At a front end of the fluting area 41 facing the first housing exterior part 3, protrusions are formed at opposing fluting edges; a first protrusion 42 and a second protrusion 43 are formed at a front edge. The protrusions 42, 43 are respectively formed by recesses 44, 45 or slits in walls defining the fluting area 41. At least one recess, the recess 45 in the shown embodiment, is formed as a receptacle for the contact part 38. The recess 44 is formed as a receptacle open towards the upper free fluting edge of the fluting area 41.

In an embodiment, the first housing exterior part 3 has a lug protruding from the abutment edge 7, in the direction of the longitudinal axis A to the rear, which is formed at the end facing the second housing exterior part 4. In the assembled state, the lug positively engages with a lug receptacle formed at the second housing exterior part 4. The lug receptacle is formed in an upper area of the second housing exterior part 4 and joins to the abutment edge 8 with its lug receptacle inlet. With the lug connection device, the first housing exterior part 3 is pressed to the second housing exterior part 4 and this pressing is then also permanently maintained.

In a rear upper end of the second housing exterior part 4 facing away from the first housing exterior part 3 and facing away from the connection flange 10, a screw hole 46 is formed as shown in FIG. 1. A separate screw 47 can be rotated into this screw hole 46, which is moreover also passed through a screw hole 48 in the first housing exterior part 3. By this configuration, a screw connection between the two housing exterior parts 3 and 4 is formed. The screw 47, in an embodiment, is made of metal such that a further protective conductor connection between the housing exterior parts 3 and 4 is additionally provided.

Figure 2:
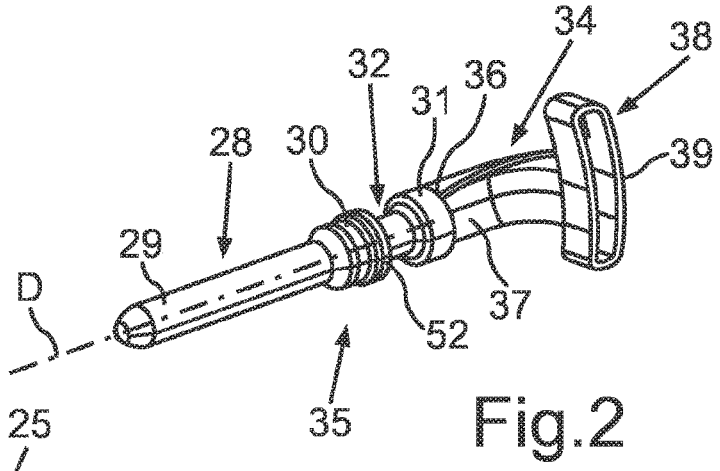
FIG. 2 is a perspective view of a protective conductor contact with an integrated protective conductor connector element.

The electrical overall contact element 35 with the protective conductor contact 28 and the protective conductor connector element 34 integrated therein is shown in FIG. 2. A trough opening of the trough-shaped support part 37 faces the contact part 38. The radial orientation of the contact part 38 to the longitudinal axis D is shown in FIG. 2. In various embodiments, the contact part 38 is oriented at an angle between 70° and 110°, between 85° and 95°, or of 90°, to the longitudinal axis D. The contact part 38 is formed at an end of the support part 37 arranged at the protective conductor contact 28. The overall contact element 35 has a rod-like shape with an end-side, hook-shaped bending.

Figure 3:
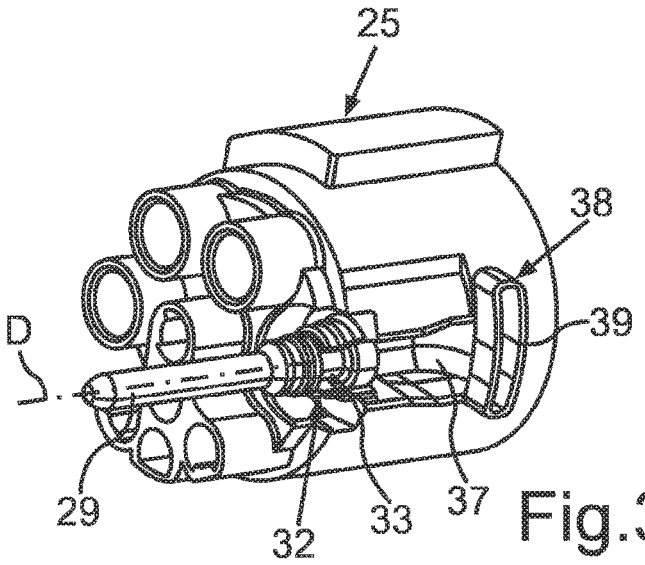
FIG. 3 is a perspective view of an insulating body of the electrical plug with the inserted protective conductor contact.

The insulating body 25 with the electrical overall contact element 35 disposed therein in a locking manner is shown in FIG. 3. The locking groove 32 is locked in the receptacle 33. The configuration in FIG. 3 is alternative to the representation in FIG. 1 with respect to the insulating body 25. Here, it can in particular be provided that the coupling stud 40 is not present.

Figure 4:
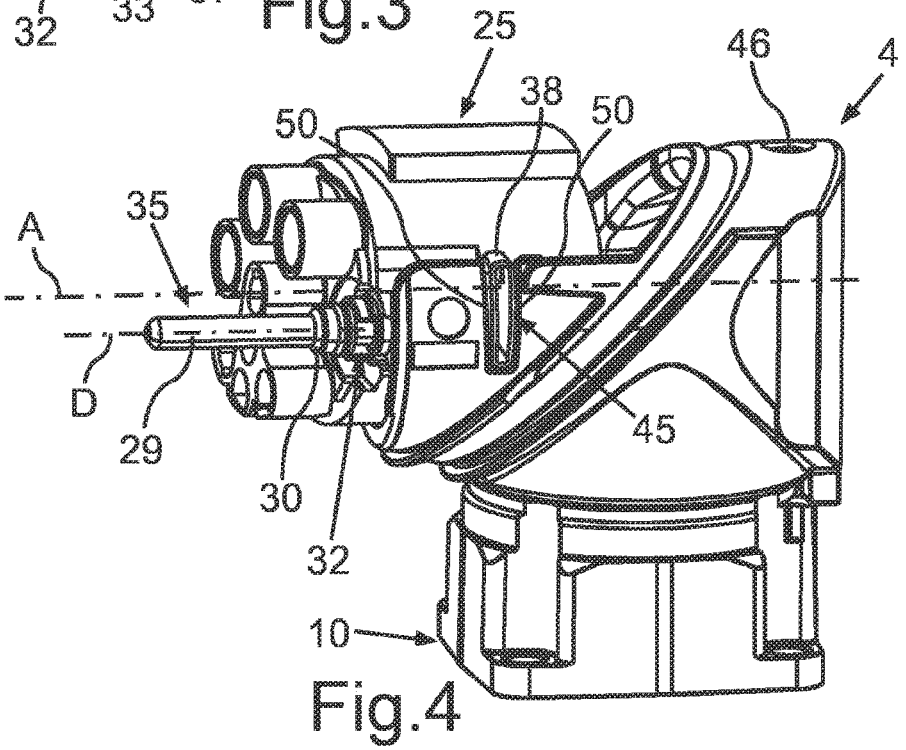
FIG. 4 is a perspective view of a second housing exterior part of the electrical plug with the insulating body of FIG. 3 inserted therein.

The inserted state of the assembly of FIG. 3 in the second housing exterior part 4 is shown in FIG. 4. Here, it is in particular apparent that the insulating body 25 is inserted into the trough area 41 from above and the contact part 38 is then inserted into the recess 45 formed as a receptacle in an accurately fitting manner. Outer sides of bounding walls of the contact part 38 abut on bounding edges of the recess 45. In an embodiment, the height of the recess 45 is dimensioned such that the contact part 38 is completely received therein. Moreover, the connected state of the connection flange 10 with the second housing part 4 is shown in FIG. 4. The contact part 38 extends into the recess 45 in a radial direction to the longitudinal axis A and directly contacts at least one bounding wall 50, by which the recess 45 is bounded in its contour. In an embodiment, the contact part 38 extends in the radial direction not as far as it contacts an inner side 49 of the second housing exterior part 4, shown in FIG. 8. An electrical connection between the overall contact element 35 and the first housing exterior part 3 is affected by the contacting element 52.

In another embodiment, the contact part 38 extends in the radial direction to the longitudinal axis A with such dimensions that it protrudes outwards beyond the trough area 41 and thus beyond the thickness of the recess 45 measured in radial direction such that the free outer edge 39 can directly contact an inner side 49 of the first housing part 3 not yet recognizable here.

Figure 5:
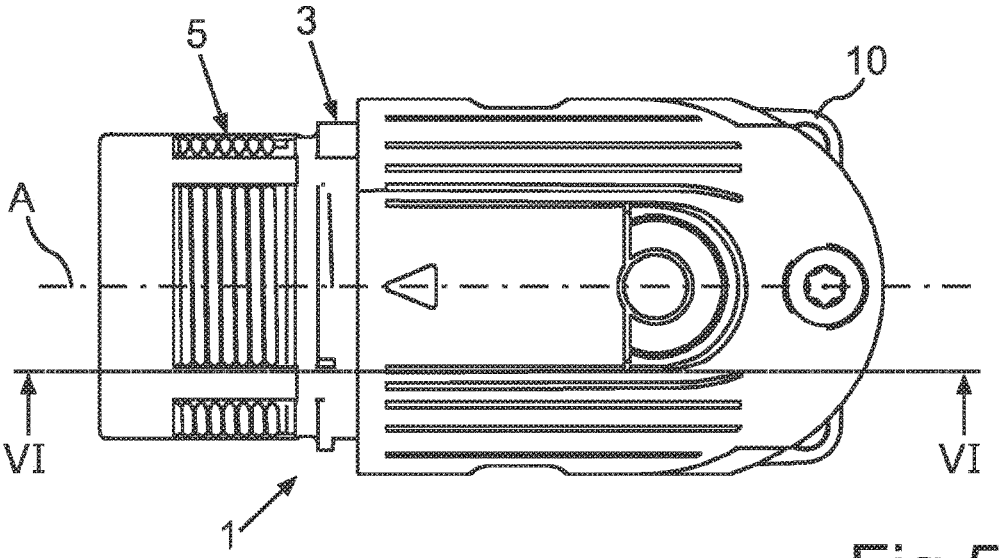
FIG. 5 is a top view of the electrical plug of FIG. 1 in an assembled state.

The axial retaining device, by which the connection flange 10 is connected to the second housing part 4, and the sectioned shaping of the electrical overall contact element 35 in the installed state are shown in FIGS. 5 and 6.

Figure 7:
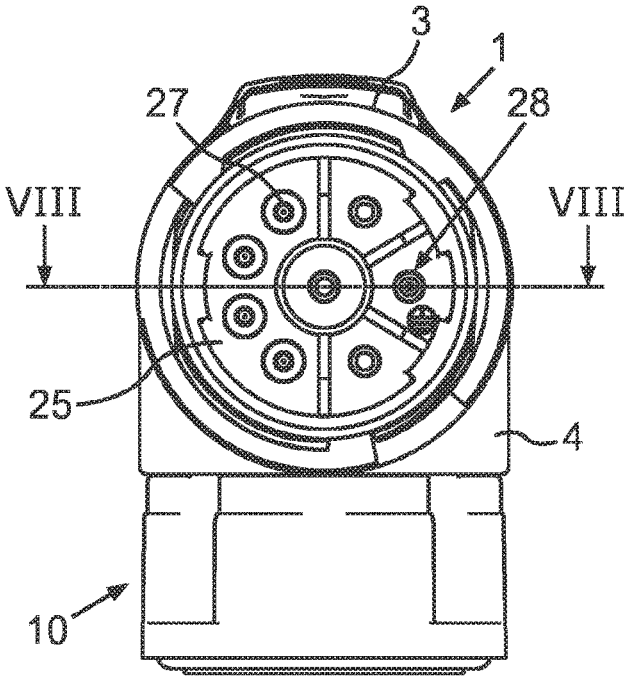
FIG. 7 is a front view of the electrical plug of FIG. 1 in the assembled state.

A pole image of the assembled electrical plug 1 is shown in FIG. 7. The pole image can, in various embodiments, be six-pole, eight-pole, or nine-pole.

Figure 8:
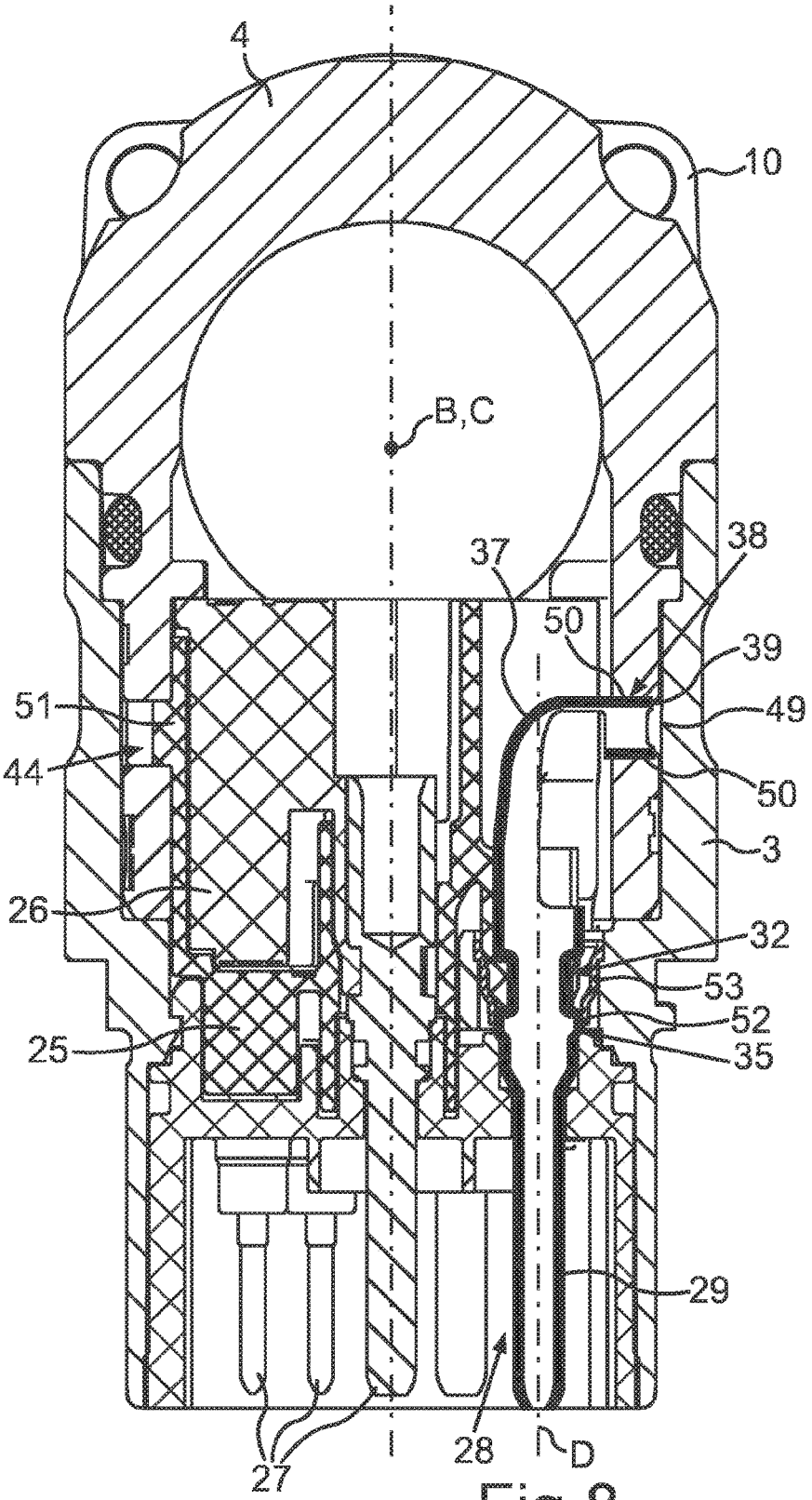
FIG. 8 is a sectional top view of the electrical plug, taken along line VIII-VIII of FIG. 7.

The shaping of the electrical overall contact element 35 is apparent in FIG. 8. Here, it is shown that the edge 39 of the contact part 38 does not directly radially abut on the inner side 49 of the first housing part 3. An electrical connection between the overall contact element 35 and the first housing exterior part 3 is formed spaced from the recess 45. The contacting element 52 directly abuts on a present ground spring 53. The ground spring 35 is a separate component, which is pressed into the first housing exterior part 3. A further direct contact of outer sides of the contact part 38 formed as a hollow body with the second housing exterior part 4 is also apparent in FIG. 8. The outer sides of the hollow body 38 directly abut on at least two bounding edges 50; a front bounding edge 50 and a rear bounding edge 50, of the recess 45 viewed in the direction of the longitudinal axis A. An outwards protruding further coupling stud 51 at the insulating body 25 radially plunges into the recess 44.

As shown in FIG. 8, the protective conductor contact 28 is arranged leading with respect to the electrical contacts 27 and thus further protruding to the front viewed in the direction of the longitudinal axis A.

Figure 9:
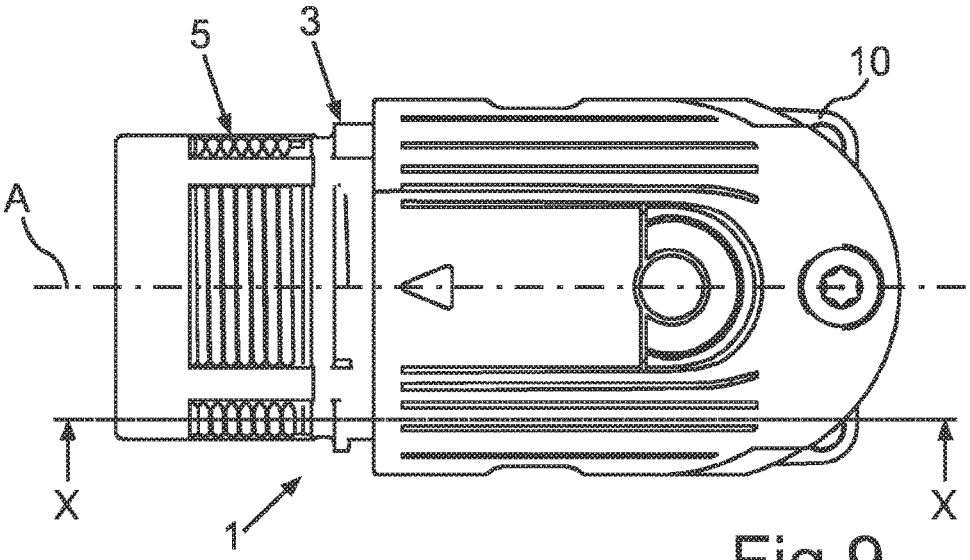
FIG. 9 is a top view of the electrical plug of FIG. 1 in the assembled state.
Figure 10:
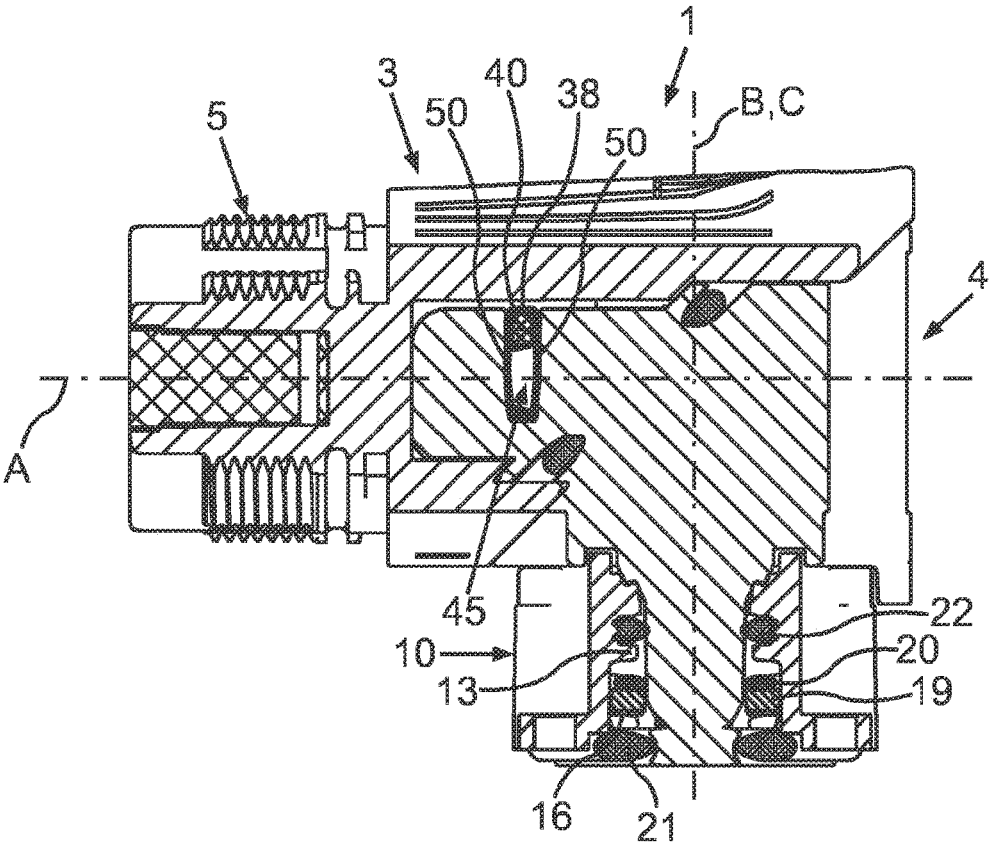
FIG. 10 is a sectional side view of the electrical plug, taken along line X-X of FIG. 9.

As shown in FIGS. 9 and 10, the outer surfaces of the contact part 38 abut on the bounding edges 50 of the recess 45.

Figure 11:
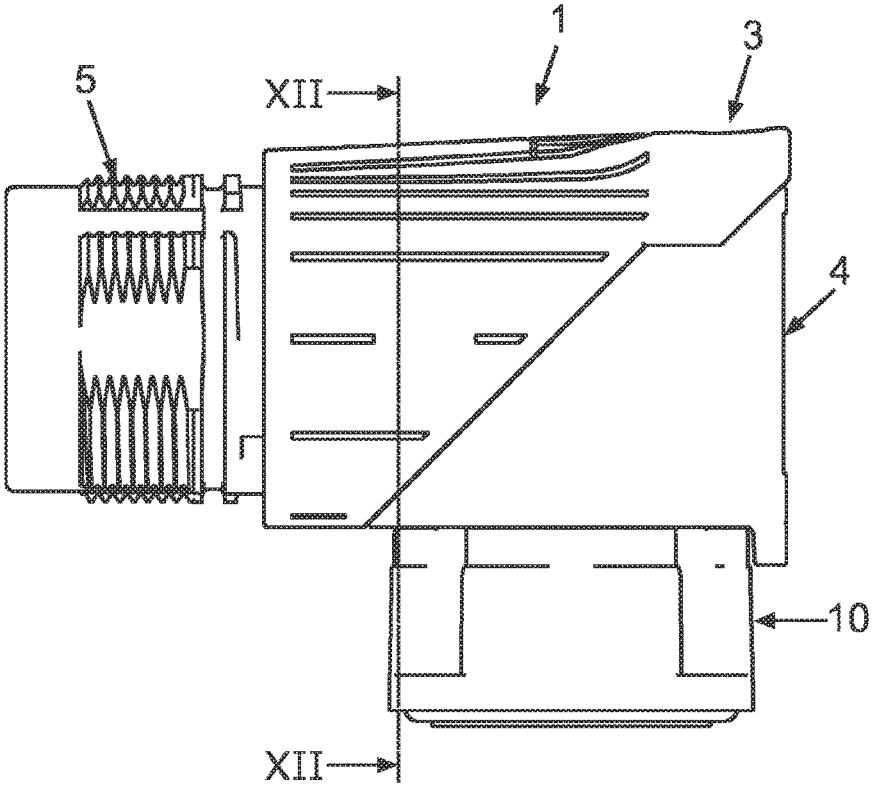
FIG. 11 is a side view of the electrical plug of FIG. 1 in the assembled state.
Figure 12:
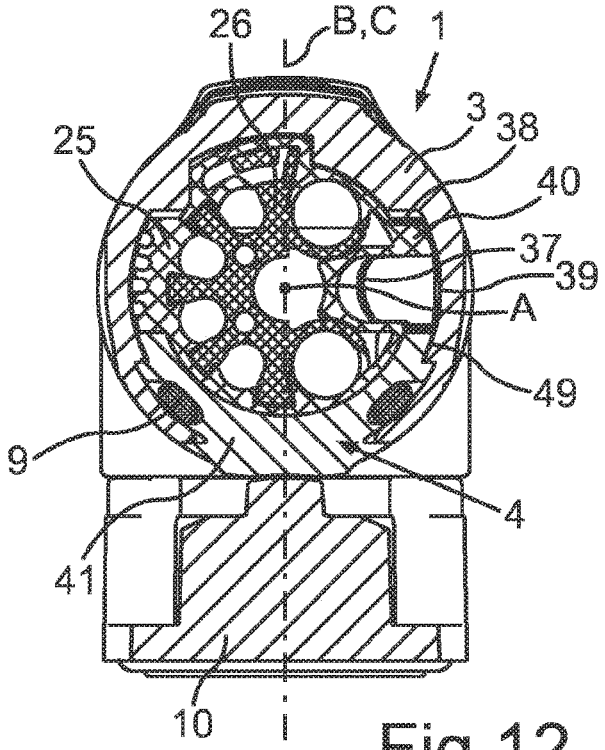
FIG. 12 is a sectional front view of the electrical plug, taken along line XII-XII of FIG. 11.

The radial abutment of the edge 39 on the inner side 49 is shown in FIGS. 11 and 12. The circumferential edge 39 has an uneven shaping, in particular a convexly curved camber, which corresponds to the concave curvature of the inner side 49. The trough-shaped configuration of the support part 37 is apparent in FIG. 12. The coupling stud 40 extends completely through the contact part 38 in the radial direction to the longitudinal axis A such that in particular a mechanic abutment of the coupling stud 40 on the inner side 49 is formed. The section in FIG. 12 is here taken through the center of the contact part 38.

In the configuration of the electrical plug 1 with at least three separate exterior parts, the first housing exterior part 3, the second housing exterior part 4, and the connection flange 10, individual ground junctions are respectively formed such that a ground connection chain is formed with respect to these ground junctions. The entire ground connection chain is formed such that a transition resistance of less than 20 mΩ is formed at all locations. The first housing exterior part 3 and/or the second housing exterior part 4 and/or the connection flange 10 are formed as a zinc die cast component.

What is claimed is:

1. An electrical plug, comprising:

a plug housing including a first housing exterior part and a second housing exterior part separate from the first housing exterior part, the first housing exterior part and the second housing exterior part are each at least partially made of metal;

a protective conductor contact disposed in the plug housing; and a protective conductor connector element disposed in the plug housing and connected to the protective conductor contact, the protective conductor connector element is integrally formed with the protective conductor contact, the protective conductor connector element has a contact part radially protruding with respect to a longitudinal axis of the protective conductor contact, the protective conductor connector element electrically connected to at least one of the first housing exterior part and the second housing exterior part.

2. The electrical plug of claim 1 wherein the protective conductor contact has a pin-like shape.

3. The electrical plug of claim 1, wherein the protective conductor connector element joins to a rear end of the protective conductor contact.

4. The electrical plug of claim 1, wherein the contact part is a hollow body with an annular or duct shape.

5. The electrical plug of claim 1, wherein the protective conductor connector element has a support part extending axially along the longitudinal axis, the contact part is connected to an end of the support part.

6. The electrical plug of claim 5, wherein the support part has a trough shape.

7. The electrical plug of claim 1, wherein the protective conductor contact has a ring web electrically connected to an inner side of the first housing exterior part.

8. The electrical plug of claim 7, wherein the ring web is connected to a ground spring disposed on the inner side of the first housing exterior part.

9. The electrical plug of claim 1, wherein the contact part extends through a recess in the second housing exterior part in a direction perpendicular to a longitudinal axis of the first housing exterior part.

10. The electrical plug of claim 9, wherein the contact part is in direct contact with the second housing exterior part at the recess.

11. The electrical plug of claim 10, wherein the contact part abuts on a pair of bounding edges of the recess.

12. The electrical plug of claim 11, wherein the recess is formed as a slit open at an edge of a trough area of the second housing exterior part.

13. The electrical plug of claim 1, further comprising an insulating body, the protective conductor contact is retained in a radially open receptacle of the insulating body in a locking manner.

14. The electrical plug of claim 13, wherein the insulating body has a coupling stud on an outer side, the coupling stud protruding from the insulating body into the contact part in a direction perpendicular to a longitudinal axis of the insulating body.

15. The electrical plug of claim 1, further comprising a connection flange formed separately from the first housing exterior part and the second housing exterior part and connected to the second housing exterior part, the connection flange is at least partially made of metal.

16. The electrical plug of claim 14, further comprising a contact ring arranged between the second housing exterior part and the connection flange and electrically connecting the second housing exterior part and the connection flange.

17. The electrical plug of claim 16, wherein the first housing exterior part, the second housing exterior part, and the connection flange form a ground connection chain with a transition resistance of less than 100 mΩ.

18. The electrical plug of claim 1, wherein the electrical plug is an angle plug and the first housing exterior part and the second housing exterior part are oriented at an angle between 60° and 120° to each other.

19. The electrical plug of claim 1, wherein the contact part protrudes further from the longitudinal axis in a radial direction than the protective conductor contact.

20. An electrical plug, comprising:

a plug housing including a first housing exterior part and a second housing exterior part separate from the first housing exterior part, the first housing exterior part and the second housing exterior part are each at least partially made of metal;

a protective conductor contact disposed in the plug housing;

a protective conductor connector element disposed in the plug housing and connected to the protective conductor contact, the protective conductor connector element electrically connected to at least one of the first housing exterior part and the second housing exterior part; and a connection flange formed separately from the first housing exterior part and the second housing exterior part and connected to the second housing exterior part, the connection flange is at least partially made of metal.

* * * * *